US007640625B2

(12) United States Patent
Oh et al.

(10) Patent No.: US 7,640,625 B2
(45) Date of Patent: Jan. 5, 2010

(54) VACUUM CLEANER

(75) Inventors: Jang-Keun Oh, Gwangju (KR); Jin-Gon Lee, Gwangju (KR); Seung-Yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 92 days.

(21) Appl. No.: 11/975,182

(22) Filed: Oct. 18, 2007

(65) Prior Publication Data

US 2008/0263816 A1 Oct. 30, 2008

Related U.S. Application Data

(60) Provisional application No. 60/926,832, filed on Apr. 30, 2007.

(30) Foreign Application Priority Data

Jun. 18, 2007 (KR) ..... 10-2007-0059485

(51) Int. Cl.
*A47L 9/20* (2006.01)
*A47L 5/34* (2006.01)

(52) U.S. Cl. ..... 15/352; 15/354

(58) Field of Classification Search ..... 15/352, 15/354

See application file for complete search history.

(56) References Cited

U.S. PATENT DOCUMENTS 2,283,836 A * 5/1942 White ..... 55/429
2,287,921 A * 6/1942 White ..... 55/357
2,287,924 A * 6/1942 White ..... 55/357
6,625,845 B2 * 9/2003 Matsumoto et al. ..... 15/353
2008/0172824 A1 * 7/2008 Yun et al. ..... 15/352

FOREIGN PATENT DOCUMENTS

JP 54103262 A * 8/1979
JP 2005-305015 11/2005
JP 2005305014 A * 11/2005
JP 2005305015 A * 11/2005
JP 2006006674 A * 1/2006
JP 2006020897 A * 1/2006
KR 20060031442 A * 4/2006
KR 1020060031442 4/2006

* cited by examiner

*Primary Examiner*—Bryan R Muller
(74) *Attorney, Agent, or Firm*—Ohlandt, Greeley, Ruggiero & Perle, L.L.P.

(57) ABSTRACT

A vacuum cleaner includes a cyclone dust separating unit which includes a cyclone part to separate dust from a dust-laden air drawn from a surface being cleaned using a centrifugal force, a dust collecting part comprising a dust chamber to accommodate the dust separated at the cyclone part, and a compressing part to compress the dust accommodated in the dust chamber. The compressing part includes a driving part to rotatably drive a driving axis, and a compressing plate driven in a substantially perpendicular direction with respect to the driving axis according to the rotation of the driving axis, and to compress the dust accommodated in the dust chamber. As a result, a vacuum cleaner is provided, which requires a minimum space for the installation of a compressing part to compress dust inside the dust collecting part, and provides maximum compressing force of the compressing part.

13 Claims, 8 Drawing Sheets

VACUUM CLEANER

CROSS-REFERENCE TO RELATED APPLICATIONS

This application claims priority from U.S. Provisional Application No. 60/926,832, filed Apr. 30, 2007, with the United States Patent and Trademark Office, and Korean Patent Application No. 10-2007-0059485, filed on Jun. 18, 2007, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to a vacuum cleaner which requires a minimum space for the installation of a compressing part to compress dust collected in a dust receptacle, and which provides maximum compressing force.

2. Description of the Related Art

A vacuum cleaner generally cleans a surface using a suction force.

In such a general vacuum cleaner, air containing dust is drawn into the vacuum cleaner, and dust is separated from the drawn-in air and stored in a predefined space. A variety of techniques have been applied to a vacuum cleaner to separate dust from air. One example is a cyclone type vacuum cleaner. A cyclone type vacuum cleaner causes the drawn air to rotate within a predefined space, generating a centrifugal force. Accordingly, dust is separated from the drawn air by use of centrifugal force. A general example of cyclone type vacuum cleaner includes a cyclone part which causes air to rotate and thus separates dust from the air using centrifugal force, and a dust collecting part which receives dust separated in the cyclone part.

Korean Patent No. 606794 discloses a technique to compress dust which is collected in a dust collecting part, by driving a compressing plate upward and downward. If dust collected in the dust collecting part is compressed, user convenience increases because users do not need to empty the dust collecting part frequently. KR606794 discloses a bar type plunger attached to the center of the compressing plate in a perpendicular relation, and the bar type plunger is driven upward and downward by the manipulation of a user. As the compressing plate is driven upward and downward within the dust collecting part, a part of the bar type plunger reciprocatingly moves out of the dust collecting part for a distance corresponding to the displacement of the compressing plate.

However, a vacuum cleaner having the above structure requires not only a space for the installation of the dust collecting part, but also a space to accommodate the plunger at its maximum displacement. Accordingly, a relatively large space has to be prepared in the vacuum cleaner to provide a structure to compress the collected dust, compromising compactness of a vacuum cleaner. Additionally, a bar type plunger provides a limited force to drive the compressing plate.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a vacuum cleaner which requires small space for installation of a structure for compressing dust collected in a dust collecting part, and which provides strong compressing force of the compressing part.

An aspect of the present disclosure provides a vacuum cleaner, including a cyclone dust separating unit which includes a cyclone part to separate dust from dust-laden air drawn from a surface being cleaned using a centrifugal force, a dust collecting part comprising a dust chamber to accommodate the dust separated at the cyclone part, and a compressing part to compress the dust accommodated in the dust chamber. The compressing part includes a driving part to rotatably drive a driving axis, and a compressing plate driven in a substantially perpendicular direction with respect to the driving axis according to the rotation of the driving axis, and to compress the dust accommodated in the dust chamber.

The compressing part may further include a screw engaged with the driving axis in a substantially linear relation, and rotated together with the driving axis, and a connecting part engaged with the screw and the compressing plate, respectively, to transmit rotational force of the screw to the compressing plate.

The screw may be substantially horizontally arranged at the upper part of the dust collecting part, and may include a first thread formed in one direction and another thread formed opposite to the first thread with reference to the middle of the length. The compressing plate may be driven within the dust chamber upward and downward according to the rotation of the screw.

The connecting part may include a first driving slider and the second driving slider engaged with the threads of opposite directions of the screw, respectively, to slide towards or away from each other according to the rotation of the screw, a first driven slider and a second driven slider positioned right below the first and second driving sliders, to slide along an upper face of the compressing plate, a first connecting rod hinged with the first driving slider with one end and hinged with the second driven slider with the other end, and a second connecting rod hinged with the second driving slider with one end, and hinged with the first driven slider with the other end.

The first and second connecting rods may be hinged with each other at a point crossing each other.

A first guide and a second guide may be provided on the upper face of the compressing plate to guide the sliding movement of the first and second driven sliders.

The driving part may include a driving motor to generate a rotational force, a driving axis rotatably driven by the driving motor, and a rotation force transmitting part to transmit rotational force of the driving motor to the driving axis.

The rotation force transmitting part may include a driving gear rotatably driven by the driving motor, and a driven gear rotated in mesh with the driving gear, to drive the driving axis. The driven gear may include a smaller number of gears than the driving gear.

The cyclone part and the dust collecting part may be arranged in substantially parallel direction, and each may share one common wall.

The wall may be open at an upper end to allow dust separated at the cyclone part to flow therethrough into the dust collecting part.

The cyclone dust separating unit may further include a filter member mounted on an outer casing of the cyclone dust separating unit, to filter remaining dust from air being discharged from the cyclone dust separating unit after the dust is separated at the cyclone part.

The vacuum cleaner may further include a wire winding unit around which an electric wire is wound, to externally supply power into the vacuum cleaner, and a filter cleaning unit rotated by a rotation force being provided from the wire winding unit when the electric wire is released from the wire winding unit, to remove dust from the filter member.

The wire winding unit may include a winding member of a substantially cylindrical configuration, around which the electric wire is wound, and a winding gear engaged with an end of the winding member, and rotated along with the winding member. The filter cleaning unit may include a cleaning screw comprising a cleaning rib in a substantially spiral configuration to remove dust from the filter member upon contact with the outer circumference of the filter member, and a cleaning gear engaged with one end of the cleaning screw and rotated in mesh with the winding gear, to rotatably drive the cleaning gear.

The cyclone dust separating unit may further include a smaller dust chamber to accommodate the dust removed from the filter member by the cleaning screw.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
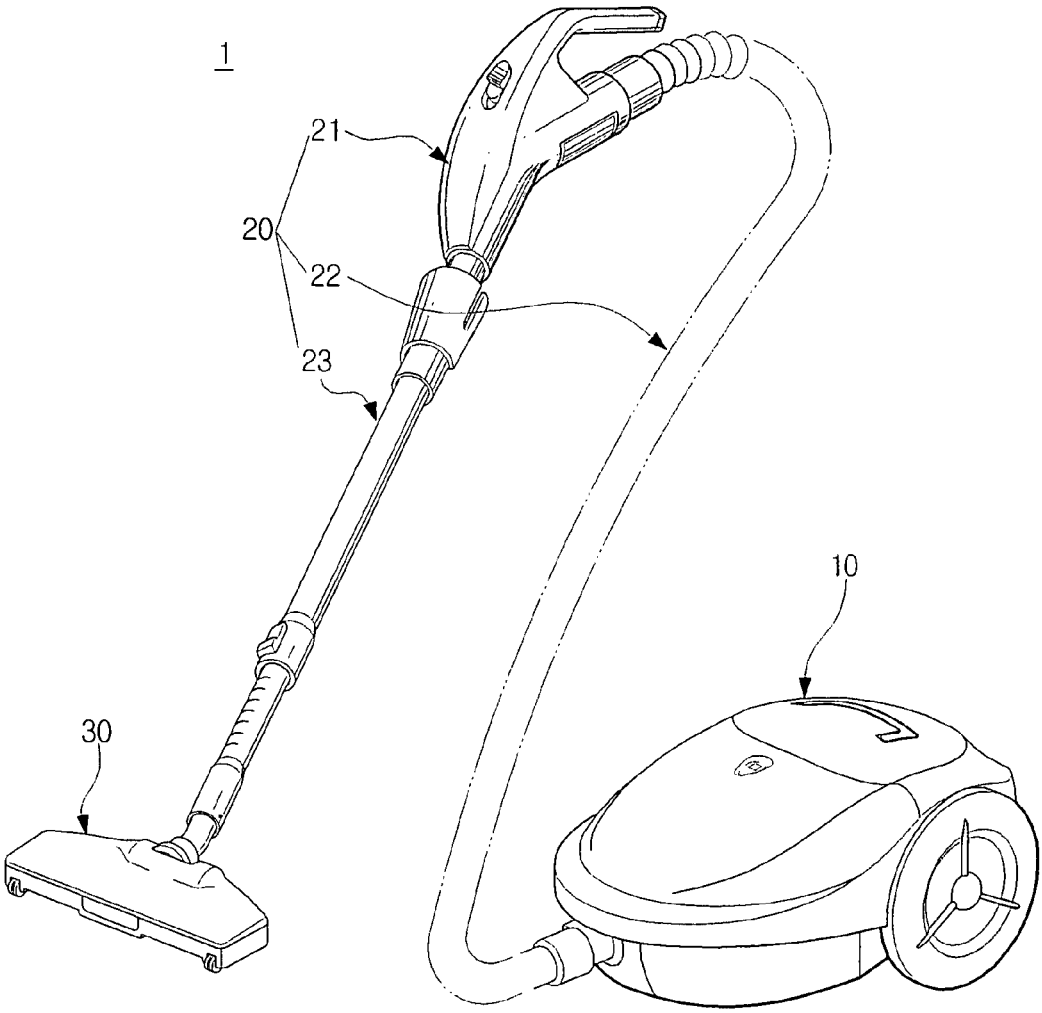
FIG. 1 is a perspective view of a vacuum cleaner according to an exemplary embodiment of the present disclosure.

Certain exemplary embodiments of the present disclosure will now be described in greater detail with reference to the accompanying drawings. In the following description, same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

Figure 2:
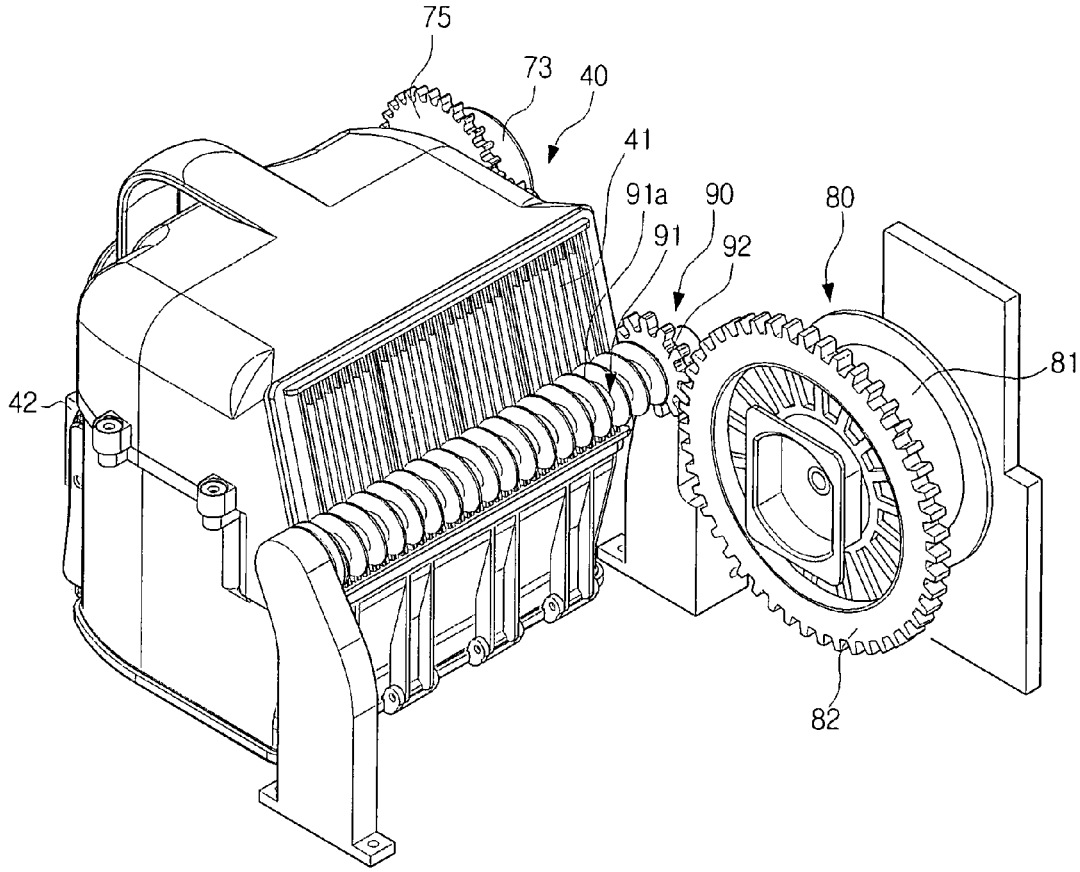
FIG. 2 is a perspective view of a cyclone dust separating unit, an electric wire winding unit, and a filter cleaning unit, all of which being housed in a main cleaner body of FIG. 1.
Figure 3:
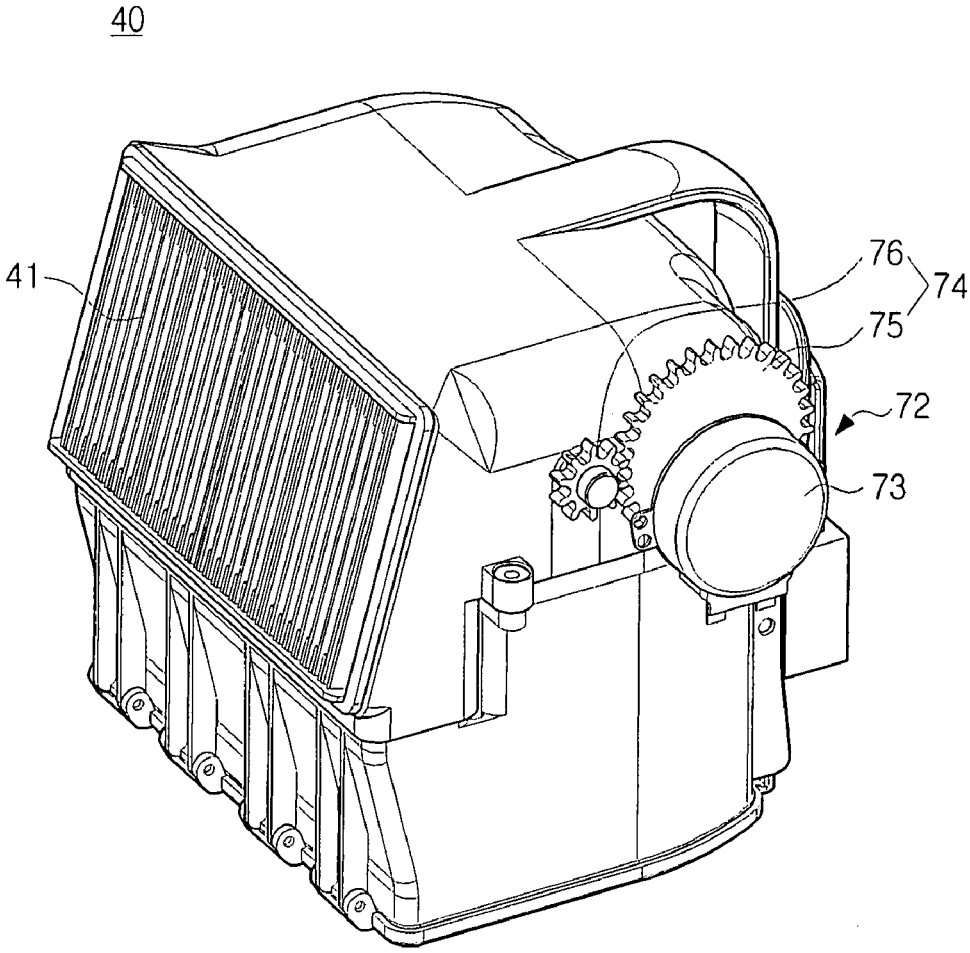
FIG. 3 is a perspective view of the cyclone dust separating unit of FIG. 2 viewed from another direction.
Figure 4:
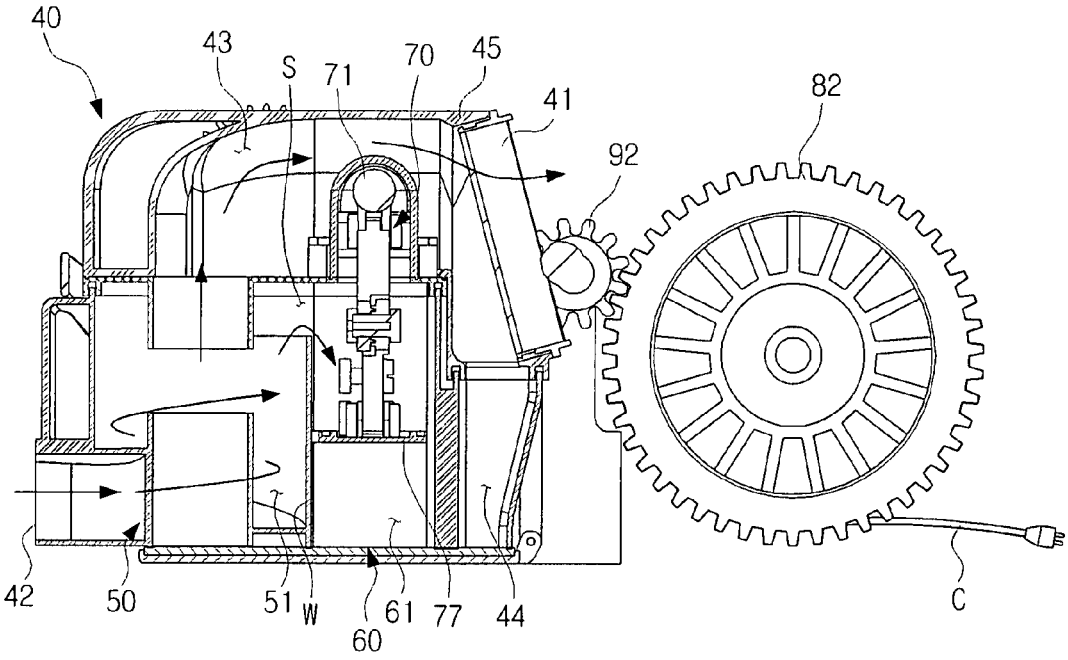
FIG. 4 is a cross section illustrating the cyclone dust separating unit, the electric wire winding unit and the filter cleaning unit of FIG. 2.
Figure 5:
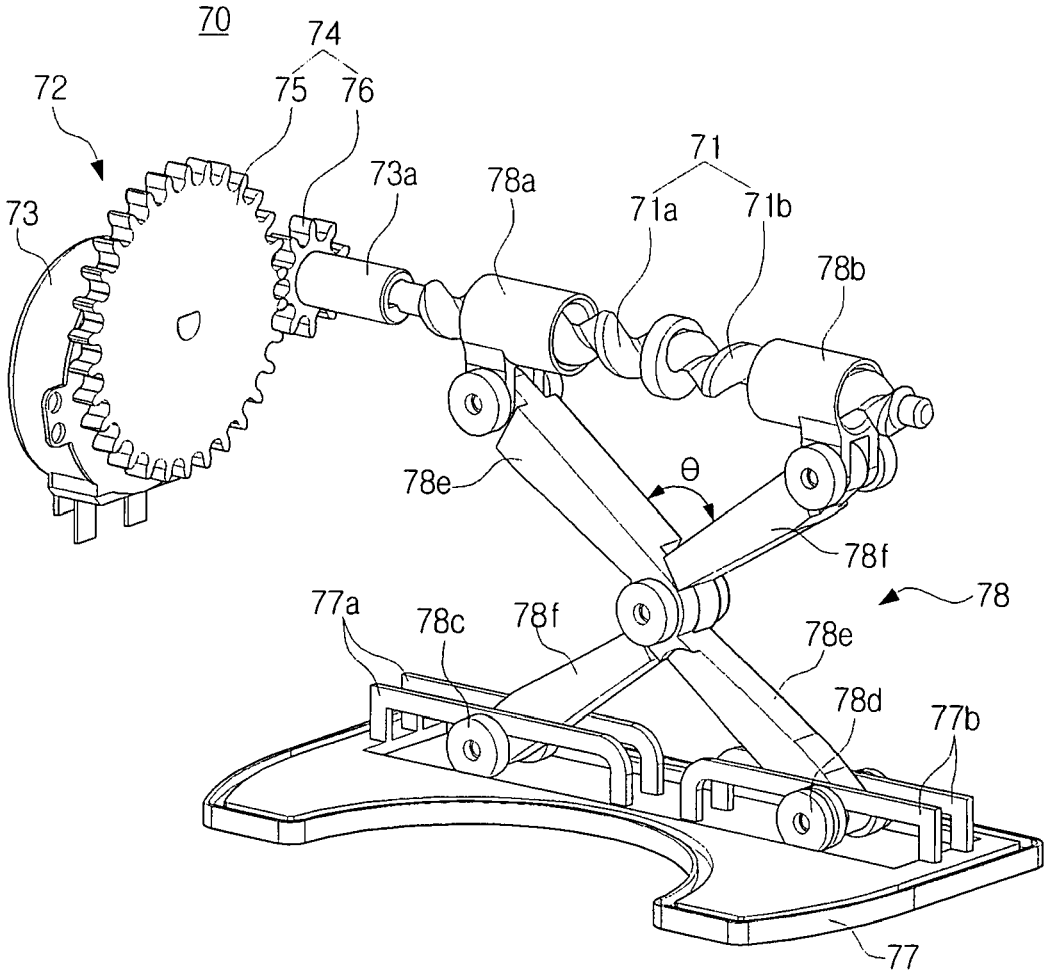
FIG. 5 is a perspective view of a compressing part provided in the cyclone dust separating unit of FIG. 3.

FIG. 1 is a perspective view of a vacuum cleaner according to an exemplary embodiment of the present disclosure, FIG. 2 is a perspective view of a cyclone dust separating unit, an electric wire winding unit, and a filter cleaning unit, all of which being housed in a main cleaner body of FIG. 1, FIG. 3 is a perspective view of the cyclone dust separating unit of FIG. 2 viewed from another direction, FIG. 4 is a cross section illustrating the cyclone dust separating unit, the electric wire winding unit and the filter cleaning unit of FIG. 2, and FIG. 5 is a perspective view of a compressing part provided in the cyclone dust separating unit of FIG. 3.

Referring to FIG. 1, a vacuum cleaner 1 according to an exemplary embodiment of the present disclosure includes a main cleaner body 10, an extension path 20, and a suction port assembly 30. The main cleaner body 10 causes a suction motor (not shown) housed therein to generate a suction force. The suction port assembly 30 draws in air and dust from a surface being cleaned, using the suction force generated within the main cleaner body 10. The main cleaner body 10 and the suction port assembly 30 are connected with each other through the extension path 20. The extension path 20 includes a handgrip 21 for a grip of a user, a suction hose 22 connecting the handgrip 21 with the main cleaner body 10, and an extension pipe 23 connecting the handgrip 21 with the suction port assembly 30.

Referring to FIGS. 2 to 5, the main cleaner body 10 includes a cyclone dust separating unit 40 which separates dust from drawn air and receives the separated dust. The cyclone dust separating unit 40 includes a cyclone part 50 to separate dust from the air drawn from the surface being cleaned, using a centrifugal force, a dust collecting part 60 having a dust chamber 61 housed therein to hold dust separated in the cyclone part 50, and a compressing part 70 to compress dust collected in the dust chamber 61.

The cyclone part 50 induces rotational movement within the air, when the air is introduced into a separating chamber 51 through an air inlet 42 (see FIGS. 2 and 4) formed at a side of the cyclone unit 40, so that dust is separated from the introduced air. Centrifugal force is generated as the drawn air is rotated, and as a result, dust is separated from the air.

The air inside the separating chamber 51 loses centrifugal force after a predetermined time, and is discharged out of the cyclone dust separating unit 40 through an air outlet 43 formed at an upper part of the separating chamber 51. The air then reaches a filter member 41 mounted on an outer casing 45 of the cyclone dust separating unit 40 at the end of the air outlet 43. The filter member 41 filters out remaining dust in the air.

The dust collecting part 60 shares one wall W with the cyclone part 50. The dust collecting part 60 is adjoined with the cyclone part 50, in substantially parallel relation. The wall W has an opening S of a predetermined height formed at the upper part, to allow the dust separated at the cyclone part 50 to pass through the opening S and to flow into the dust chamber 61 of the dust collecting part 60. A compressing plate 77 is provided within the dust collecting part 60. The compressing plate 77 reaches its uppermost displacement position, when dust moves from the cyclone part 50 into the dust collecting part 60 through the opening S at the upper part of the wall W.

The compressing part 70 compresses dust collected in the dust chamber 61 of the dust collecting part 60, to minimize the volume of the dust. As a result, dust chamber 61 may have reduced capacity, and still be used for a longer period of time.

Referring to FIG. 5, the compressing part 70 includes a screw 71 horizontally arranged at the upper part of the dust collecting part 60, a driving part 72 to rotatably drive a driving axis 73*a*, the compressing plate 77 to be driven upward and downward within the dust chamber 61 according to the rotation of the screw 71, and a connecting part 78 connected to the screw 71 and the compressing plate 77 to transmit the rotational force of the screw 71 to the compressing plate 77. The screw 71 has a thread formed along the half of the length, and an opposite thread formed along the other half of the length. More specifically, and referring to FIG. 5, the screw 71 may include a first screw 71*a* having a thread along a left half of the length, and a second screw 71*b* having a thread opposite to the first screw 71*a* along a right half of the length.

The driving part 72 includes a driving motor 73 formed adjacent to one side of the screw 71 to generate a rotational force, a driving axis 73*a* driven by the driving motor 73 and engaged with the screw 71 in a linear relation, and a rotational force transmitting part 74 to transmit the rotational force of the driving motor 73 to the driving axis 73*a*. The rotational force transmitting part 74 includes a driving gear 75 rotatably driven by the driving motor 73, and a driven gear 76 rotated in mesh with the driving gear 75 to rotate the screw 71. It is desirable that the driven gear 76 may have a less number of gears than the driving gear 75, because by doing so, larger rotational force can be transmitted to the screw 71 from the same output of the driving motor 73.

The compressing plate 77 may be implemented as a plate of a predetermined thickness, which is configured in conformity with a traverse cross section of the dust chamber 61. The compressing plate 77 operates to compress dust collected inside the dust chamber 61, by moving upward and downward within the dust chamber 61. First and second driven sliders 78*c*, 78*d*, and first and second guides 77*a*, 77*b* to guide the sliding movement of the first and second driven sliders 78*c*, 78*d*, are mounted on the upper face of the compressing plate 77. This will be explained below.

The connecting part 78 includes first and second driving sliders 78*a*, 78*b* sliding opposite to each other according to the rotation of the screw 71, the first and second driven sliders 78*c*, 78*d* positioned right below the first and second driving sliders 78*a*, 78*b*, and sliding on the upper face of the compressing plate 77, a first connecting rod 78*e* hinged to the first driving slider 78*a* with one end, and hinged to the second driven slider 78*d* with the other end, and a second connecting rod 78*f* hinged with the second driving slider 78*b* with one end, and hinged to the first driven slider 78*c* with the other end.

As explained above, the screw 71 includes the first and second screws 71*a*, 71*b*, having threads opposite to each other. The first driving slider 78*a* is screw-engaged with the first screw 71*a*, and the second driving slider 78*b* is screw-engaged with the second screw 71*b*. Because the first and second driving sliders 78*a*, 78*b* are engaged with the first and second screws 71*a*, 71*b* having threads opposite to each other, the first and second driving sliders 78*a*, 78*b* slide opposite to each other when the screw 71 is rotated.

The first and second driven sliders 78*c*, 78*d* are guided by the first and second guides 77*a*, 77*b* provided at the upper part of the compressing plate 77, and slid along the upper face of the compressing plate 77. During sliding movement of the first and second driving sliders 78*a*, 78*b* and the first and second driven sliders 78*c*, 78*d*, the first driven slider 78*c* is positioned right below the first driving slider 78*a*, and the second driven slider 78*d* is positioned right below the second driving slider 78*b*.

The first and second connecting rods 78*e*, 78*f* are hinged to each other at a crossing point. As the screw 71 rotates, an angle between the first and second connecting rods 78*e*, 78*f* is varied. In particular, the first and second connecting rods 78*e*, 78*f* may be at about 0 degrees when the first and second driving sliders 78*a*, 78*b* are closest to each other. In this state, the compressing plate 77 is at the lowermost displacement position. As the screw 71 rotates the first and second driving sliders 78*a*, 78*b* away from each other so the first and second driving sliders 78*a*, 78*b* are spaced apart from each other by a maximum distance, the first and second connecting rods 78*e*, 78*f* are at angle about 180 degrees. In this state, the compressing plate 77 is at an uppermost displacement position.

Referring to FIGS. 2 and 4, the main cleaner body 10 may include a wire winding unit 80 to wind an electric wire C to supply power to the vacuum cleaner 1, and a filter cleaning unit 90 to be transmitted with a rotational force of the wire winding unit 80 and to remove dust from the filter member 41 of the cyclone dust separating unit 40.

The wire winding unit 80 includes a cylindrical winding member 81 around which wire is wrapped, and a winding gear 82 engaged with an end of the winding member 81 to be rotated along with the winding member 81. In the example shown in FIG. 4, a wire to supply power for the driving of the vacuum cleaner 1, is wrapped around the winding member 81. As a user pulls one end of the wire C from the winding member 81, the winding member 81 rotates, and as a result, wire C is released from the winding member 81. The winding gear 82, engaged with the winding member 81, is rotated together with the winding member 81.

The filter cleaning unit 90 includes a cleaning gear 92 rotated in mesh with the winding gear 82, and a cleaning screw 91 having cleaning ribs 91*a* formed on the outer circumference. Accordingly, the cleaning gear 92, in mesh with the winding gear 82, is rotated together with the winding gear 82, as a user releases a wire C from the winding member 81. At the same time, the cleaning screw 91, in mesh with the cleaning gear 92, is rotated together with the cleaning gear 92. In the rotating movement of the cleaning screw 91, the cleaning ribs 91*a* on its outer circumference hit the outer side of the filter member 41, and by the impact of the cleaning ribs 91*a* on the outer side of the filter member 41, dust is removed from the inner side of the filter member 41.

The cyclone dust separating unit 40 may have a separate dust chamber 44 (FIG. 4), which is generally smaller in size, to collect the dust removed from the filter member 41 by the impact of the cleaning ribs 91*a* on the outer side of the filter member 41.

The operation of the vacuum cleaner 1 constructed above according to the exemplary embodiment of the present disclosure will be explained below, with reference to FIG. 4, and FIGS. 6 to 8.

Figure 6:
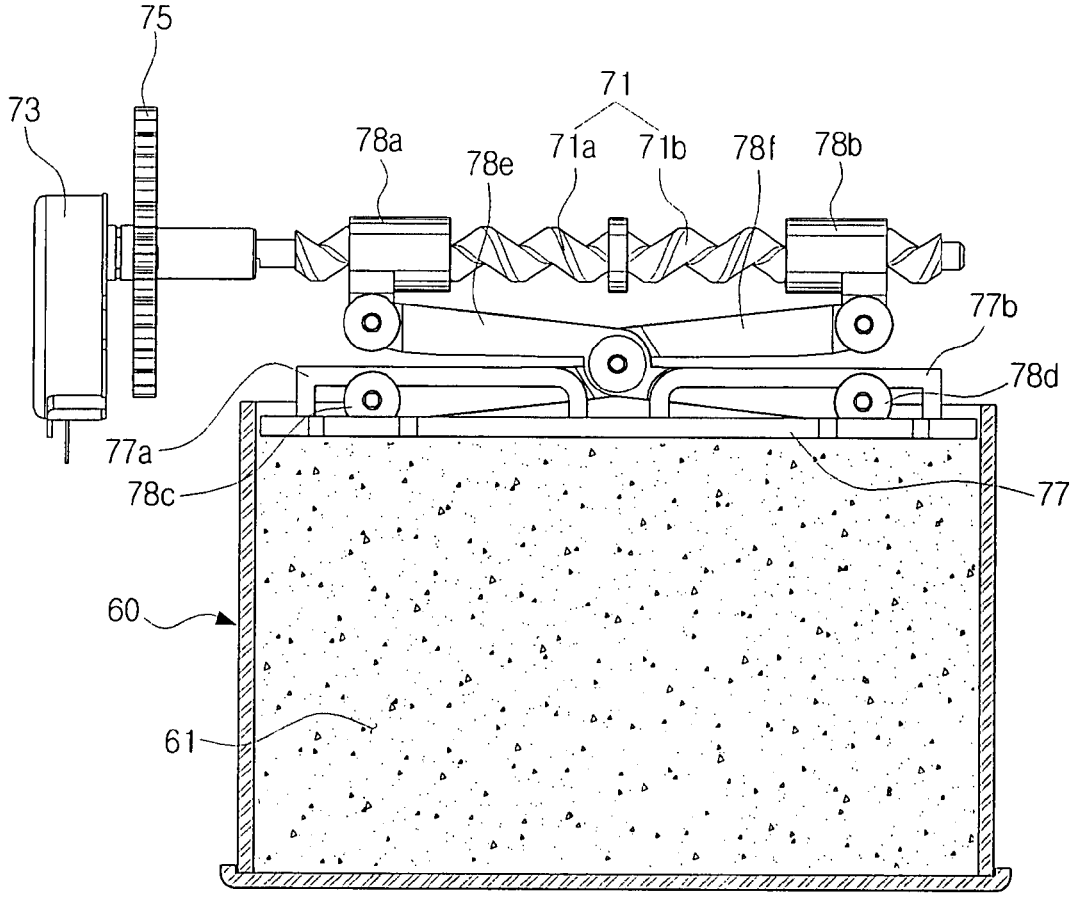
FIG. 6 illustrates the interior of the cyclone dust separating unit before dust compression.
Figure 7:
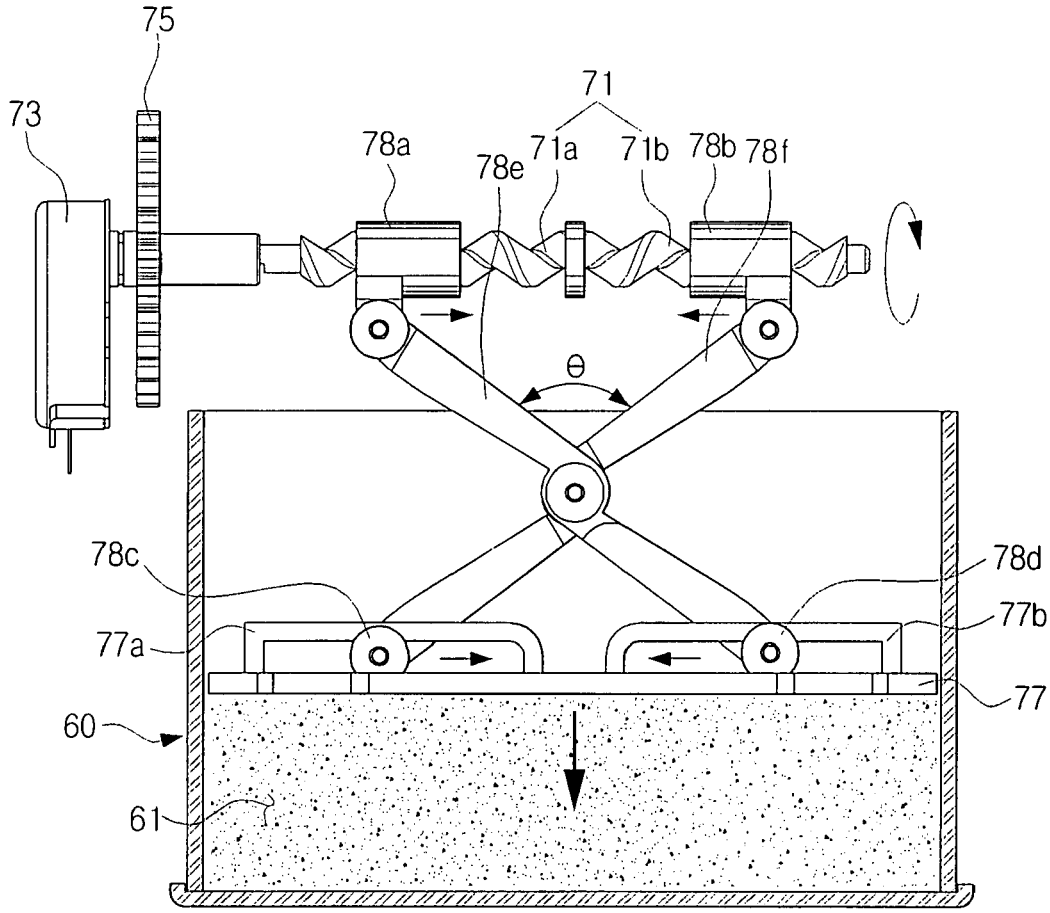
FIG. 7 illustrates the interior of the cyclone dust separating unit after dust compression.
Figure 8:
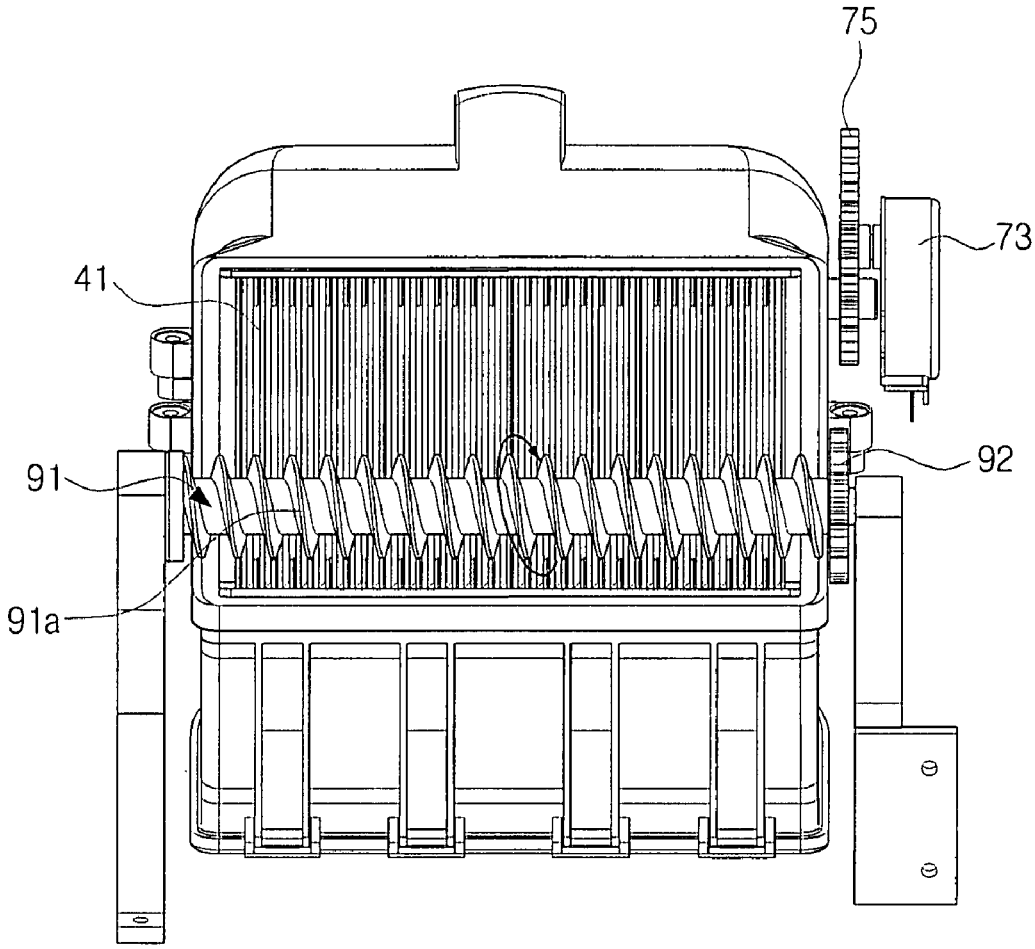
FIG. 8 illustrates the filter cleaning unit of FIG. 2 removing dust from the filter member.

FIG. 6 illustrates the interior of the cyclone dust separating unit before dust compression, FIG. 7 illustrates the interior of the cyclone dust separating unit after dust compression, and FIG. 8 illustrates the filter cleaning unit of FIG. 2 removing dust from the filter member.

The vacuum cleaner 1 starts driving, drawing in dust and air from a surface being cleaned through the suction port assembly 30. The drawn air passes the extension path 20, and is introduced into the main cleaner body 10.

Referring to FIG. 4, the drawn air in the main cleaner body 10 flows to the cyclone dust separating unit 40 within the main cleaner body 10. The air has a rotational movement inside the separating chamber 51 of the cyclone part 50. Due to the rotational movement of the drawn air, dust is separated from the air by centrifugal force. The air eventually loses centrifugal force, and escapes the cyclone dust separating unit 40 through the air outlet 43 formed at the upper part of the separating chamber 51. At this time, the air meets the filter member 41 mounted on the outer casing 45 of the cyclone dust separating unit 40 at the end of the air outlet 43, so that the filter member 41 filters out remaining dust of the air.

Dust centrifuged at the separating chamber 51 is introduced into the dust chamber 61 inside the dust collecting part 60, through the opening S formed at the upper end of the wall W. At this time, the compressing plate 77 provided within the dust chamber 61 is at its uppermost displacement position (FIG. 6). A user may drive the driving motor 73 of the compressing unit 70, to compress the dust collected in the dust chamber 61. As the driving motor 73 is operated, the screw 71, provided horizontally at the upper side of the dust chamber 61, is rotated.

Referring to FIG. 7, the first and second driving sliders 78*a*, 78*b*, which are slidably engaged with the first and second screws 71*a*, 71*b*, are slid towards each other. Accordingly, an angle (κ) decreases between the first and second connecting rods 78*e*, 78*f*, which are hinged with the first and second driving sliders 78*a*, 78*b*. Additionally, the second and the first driven sliders 78*d*, 78*c*, hinged to the first and second connecting rods 78*e*, 78*f*, slide along the upper face of the compressing plate 77 towards each other, thereby causing the compressing plate 77 at the upper part of the dust chamber 61 to be lowered. When the compressing plate 77 is lowered, dust is compressed in the dust chamber 61 by the force exerted by the compressing plate 77.

As explained above, relatively strong compressing force can be provided by the compressing plate 77, by driving the compressing plate 77 upward and downward through the screw 71 and the connecting rods 78*e*, 78*f*. Because the driving force from the driving motor 73 is provided through the two connecting rods 78*e*, 78*f*, forces of the two connecting rods 78*e*, 78*f* are combined and applied to the compressing plate 77 when the compressing plate 77 is lowered.

Because the connecting rods 78*e*, 78*f* are most of times moved within the dust chamber 61, the compressing part 70 to compress dust inside the dust chamber 61 can be provided to the vacuum cleaner 1, with improved space utilization. The above feature is far more advantageous, when compared with a conventional case which moves a bar type plunger vertically engaged with the compressing plate 77 upward and downward to compress the dust. In particular, the plunger is impossible to move out of the dust chamber 61, while maintaining the same displacement as that of the compressing plate 77.

Meanwhile, dust may be removed from the inner side of the filter member 41, before the vacuum cleaner 1 is driven. The winding member 81 and the winding gear 82 (FIG. 2) are rotated together, when the wire C (FIG. 4) is released from the winding member 81 (FIG. 2), and in this situation, the cleaning gear 92 is rotated in mesh with the winding gear 82. Accordingly, as shown in FIG. 8, the cleaning screw 91 engaged with the cleaning gear 92 is rotated, so that the cleaning ribs 91*a* formed on the outer circumference of the cleaning screw 91 hit the outer surface of the filter member 41. Dust is removed from the inner side of the filter member 41 by hitting the outer surface of the filter member 41 with the cleaning ribs 91*a*, and dropped and collected in the smaller dust chamber 44 provided within the cyclone dust separating unit 40.

As explained above, by providing the cleaning screw 91 which automatically removes dust from the filter member 41 in association with the movement of the winding member 81 to release the wire C, user inconvenience of having to remove dust from the filter member 41 manually, is prevented.

As explained above, according to the exemplary embodiments of the present disclosure, a vacuum cleaner is provided, which requires a small space for the installation of a compressing part to compress dust inside the dust collecting part, and provides a strong compressing force of the compressing part.

Furthermore, a vacuum cleaner is provided, which automatically removes dust from the filter member in association with the movement to release an electric wire, and which accordingly save user inconvenience of having to remove dust manually.

The foregoing embodiments are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner, comprising:

a cyclone dust separating unit comprising, a cyclone part to separate dust from dust-laden air drawn from a surface being cleaned using a centrifugal force, a dust collecting part comprising a dust chamber to accommodate the dust separated at the cyclone part, and a compressing part to compress the dust accommodated in the dust chamber, the compressing part comprising, a screw that is substantially horizontally arranged at the upper part of the dust collecting part, and comprises a first thread formed in one direction and a second thread formed opposite to the first thread with reference to a middle of a length of the screw;

a driving part to rotatably drive the screw, and a compressing plate driven in a substantially perpendicular direction with respect to the screw according to the rotation of the driving screw, and to compress the dust accommodated in the dust chamber.

2. The vacuum cleaner of claim 1, wherein the compressing part further comprises:

a connecting part engaged with the screw and the compressing plate, respectively, to transmit rotational force of the screw to the compressing plate.

3. The vacuum cleaner of claim 2, wherein the connecting part comprises:

a first driving slider and a second driving slider engaged with the first thread and the second thread of opposite directions of the screw, respectively, to slide towards or away from each other according to a rotation of the screw;

a first driven slider positioned right below a first driving slider and a second driven slider positioned right below a second driving slider and the first driven slider and the second driven slider are configured to slide along an upper face of the compressing plate;

a first connecting rod hinged with the first driving slider with one end and hinged with the second driven slider with the other end; and a second connecting rod hinged with the second driving slider with one end, and hinged with the first driven slider with the other end.

4. The vacuum cleaner of claim 3, wherein the first connecting rod and the second connecting rod are hinged with each other at a point crossing each other.

5. The vacuum cleaner of claim 3, wherein a first guide and a second guide are provided on the upper face of the compressing plate to guide sliding movement of the first driven slider and the second driven slider.

6. The vacuum cleaner of claim 1, wherein the driving part comprises:

a driving motor to generate a rotational force and rotatably drive the screw; and a rotation force transmitting part to transmit rotational force of the driving motor to the screw.

7. The vacuum cleaner of claim 6, wherein the rotation force transmitting part comprises:

a driving gear rotatably driven by the driving motor; and a driven gear rotated in mesh with the driving gear, to drive the screw, and wherein the driven gear comprises a smaller number of teeth than the driving gear.

8. The vacuum cleaner of claim 1, wherein the cyclone part and the dust collecting part are arranged in adjacent to one another, and each shares one common wall.

9. The vacuum cleaner of claim 8, wherein the wall is open at an upper end to allow dust separated at the cyclone part to flow therethrough into the dust collecting part.

10. The vacuum cleaner of claim 1, wherein the cyclone dust separating unit further comprises:

a filter member mounted on an outer casing of the cyclone dust separating unit, to filter remaining dust from air being discharged from the cyclone dust separating unit after the dust is separated at the cyclone part.

11. The vacuum cleaner of claim 10, further comprising:

a wire winding unit around which an electric wire is wound, to externally supply power into the vacuum cleaner; and a filter cleaning unit rotated by a rotation force being provided from the wire winding unit when the electric wire is released from the wire winding unit, to remove dust from the filter member.

12. The vacuum cleaner of claim 11, wherein the wire winding unit comprises:

a winding member of a substantially cylindrical configuration, around which the electric wire is wound; and a winding gear engaged with an end of the winding member, and rotated along with the winding member, and wherein the filter cleaning unit comprises, a cleaning screw comprising a cleaning rib in a substantially spiral configuration to remove dust from the filter member in contact with an outer circumference of the filter member, and a cleaning gear engaged with one end of the cleaning screw and rotated in mesh with the winding gear, to rotatably drive the cleaning gear.

13. The vacuum cleaner of claim 12, wherein the cyclone dust separating unit further comprises a smaller dust chamber to accommodate the dust removed from the filter member by the cleaning screw.

* * * * *